US007497913B2

(12) United States Patent
Rastegar et al.

(10) Patent No.: US 7,497,913 B2
(45) Date of Patent: Mar. 3, 2009

(54) METHOD AND APPARATUS FOR COLLOIDAL PARTICLE CLEANING

(75) Inventors: Abbas Rastegar, Schenectady, NY (US); Sean Eichenlaub, Red Hook, NY (US)

(73) Assignee: Sematech Inc., Austin, TX (US)

( * ) Notice: Subject to any disclaimer, the term of this patent is extended or adjusted under 35 U.S.C. 154(b) by 237 days.

(21) Appl. No.: 11/414,146

(22) Filed: Apr. 28, 2006

(65) Prior Publication Data

US 2006/0260662 A1 Nov. 23, 2006

Related U.S. Application Data

(60) Provisional application No. 60/675,826, filed on Apr. 28, 2005.

(51) Int. Cl.

| | |
|---|---|
| ***B08B 7/00*** | (2006.01) |
| ***B08B 7/04*** | (2006.01) |
| ***B08B 3/00*** | (2006.01) |
| ***B08B 3/04*** | (2006.01) |

(52) U.S. Cl. ..... 134/6; 134/7; 134/9; 134/10; 134/34; 134/36; 134/902

(58) Field of Classification Search ..... 134/6, 134/7, 9, 18, 34, 36, 902; 451/39, 40
See application file for complete search history.

(56) References Cited

U.S. PATENT DOCUMENTS

| | | | | |
|---|---|---|---|---|
| 5,865,901 | A * | 2/1999 | Yin et al. | 134/2 |
| 5,996,594 | A * | 12/1999 | Roy et al. | 134/1.3 |
| 6,554,909 | B1 * | 4/2003 | Haerle et al. | 134/6 |
| 6,599,174 | B1 * | 7/2003 | Spikes, Jr. | 451/57 |
| 2003/0054734 | A1 * | 3/2003 | Mullee et al. | 451/41 |
| 2003/0121214 | A1 * | 7/2003 | Ishibashi | 51/309 |

* cited by examiner

*Primary Examiner*—Alexander Markoff
*Assistant Examiner*—Nicole Blan
(74) *Attorney, Agent, or Firm*—Fulbright & Jaworski LLP

(57) ABSTRACT

Methods and apparatuses for cleaning a surface is provided. In one embodiment, a method includes the step of determining the type and size of the contaminant particles. A solution, which may include a plurality of variable size particles, may be selected such that an appropriate size cleaning particle is used during the cleaning process. The solution may include polystyrene latex particles or other cleaning particles. Alternatively, the solution may be a slurry. The solution and particles are delivered to the surface via a nozzle at a velocity that does not damage the surface and that clears the contaminants from the surface.

11 Claims, 4 Drawing Sheets

METHOD AND APPARATUS FOR COLLOIDAL PARTICLE CLEANING

This patent application claims priority to, and incorporates by reference in its entirety, U.S. provisional patent application Ser. No. 60/675,826 filed on Apr. 28, 2005.

BACKGROUND OF THE INVENTION

1. Field of the Invention

The present invention relates generally to semiconductor fabrication, and more particularly to an apparatus and method for removing particles from a surface.

2. Description of Related Art

Removal of sub-100 nanometer (nm) particles from a surface can be a challenging subject for semiconductor fabrication processes. The surface-particle interactions depend on the material and the surface structure and generally are size independent. To remove a particle from a surface, the adhesive forces between the particle and the surface need to be broken and the particle needs to be transported far enough away from the surface so that the particle will not be redeposited on the surface.

Currently, semiconductor technology uses reflective optics which requires a surface roughness of approximately 1.5 Angstrom RMS. However, the incident light is scattered by the rough surfaces and it leads to the loss of intensity of the reflected light and image deformation. Hence, the conventional wet cleaning techniques that uses under etching of particle to remove it from the surface no longer are applicable.

Other examples for removing particles from a surface include transferring of energy to a particle, where the energy transfer efficiency to a particle on a surface strongly depends on the size of the particle on the surface. However, this method can only be used to remove "soft" defects, where particles like particle 10A that adhere to surface 12A due to van der Waals and electrostatic forces, as illustrated in FIG. 1A. It is much more difficult to remove particles (e.g., particles 10B) that are chemically bonded to a surface (e.g., 12B), known as "hard" defects, shown in FIG. 1B.

Another example for removing particles uses cryogenic cleaning. A jet of material, which may include some type of cleaning particle 14, may be expelled from the cryogenic cleaner and the transfer energy from jet to the contaminant particles 10C, as shown in FIG. 2. However, the cryogenic process makes it difficult to produce a narrow distribution of particle sizes, which makes it very difficult to remove smaller contaminant particles from the surface. Referring to FIG. 3, larger cleaning particles, such as cleaning particle 14A in a distribution will not be able to remove smaller particles 10D from surface 12D. Further, the use of larger cleaning particles can cause damage to the surface, making it impossible to achieve a surface roughness of 1.5 Angstroms RMS.

The referenced shortcomings are not intended to be exhaustive, but rather are among many that tend to impair the effectiveness of previously known techniques concerning surface cleaning; however, those mentioned here are sufficient to demonstrate that the methodologies appearing in the art have not been satisfactory and that a significant need exists for the techniques described and claimed in this disclosure.

SUMMARY OF THE INVENTION

For particles, such as sub 100 nm particles, a cleaning solution including particles may be used to separate contaminant particles from a surface. In one respect, a surface cleaning apparatus is provided. The surface cleaning apparatus may include a station adapted to secure a surface (e.g., wafer, mask, glass plate, etc.) comprising contaminant particles. The station may include a rotating a plate for securing the surface and a rotating chuck for rotating the surface to minimize surface damage.

The surface cleaning apparatus may also include at least one reservoir containing a cleaning solution including suspended cleaning particles. A nozzle coupled to the at least one reservoir may be used to direct a stream of cleaning solution and suspended cleaning particles from the at least one reservoir towards the station. In one embodiment, the stream may include cleaning particles selected to have a size substantially similar to a size of the contaminant particles.

In some embodiments, the surface cleaning apparatus may also include a filter coupled to the at least one reservoir. The filter may filter the cleaning solution to produce a filtered cleaning solution having the selected size.

In other embodiments, the surface cleaning apparatus may also include a selector for selecting a reservoir from the at least on reservoirs. In particular, the selector may select the reservoir containing cleaning particles having a size substantially similar to the size of the contaminant particles.

In other respects, a method is provided. A surface contaminated with contaminant particles may be provided and the size of the contaminant particles is determined. A solution including a plurality of cleaning particles may be selected, where the size of the cleaning solution is substantially equal to the size of the contaminant particles. The solution and the selected cleaning particles are delivered to the surface for removing the contaminant particles.

In one respect, the method may provide a cleaning solution including variable size cleaning particles. The method may provide a filtering step for producing a filtered cleaning solution including a plurality of cleaning particles having a size substantially equal to a size of the contaminant particles.

The term "coupled" is defined as connected, although not necessarily directly, and not necessarily mechanically.

The terms "a" and "an" are defined as one or more unless this disclosure explicitly requires otherwise.

The term "substantially" and its variations are defined as being largely but not necessarily wholly what is specified as understood by one of ordinary skill in the art, and in one non-limiting embodiment "substantially" refers to ranges within 10%, preferably within 5%, more preferably within 1%, and most preferably within 0.5% of what is specified.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements possesses those one or more steps or elements, but is not limited to possessing only those one or more elements. Likewise, a step of a method or an element of a device that "comprises," "has," "includes" or "contains" one or more features possesses those one or more features, but is not limited to possessing only those one or more features. Furthermore, a device or structure that is configured in a certain way is configured in at least that way, but may also be configured in ways that are not listed.

Other features and associated advantages will become apparent with reference to the following detailed description of specific embodiments in connection with the accompanying drawings.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DESCRIPTION OF ILLUSTRATIVE EMBODIMENTS

The invention and the various features and advantageous details are explained more fully with reference to the nonlimiting embodiments that are illustrated in the accompanying drawings and detailed in the following description. Descriptions of well known starting materials, processing techniques, components, and equipment are omitted so as not to unnecessarily obscure the invention in detail. It should be understood, however, that the detailed description and the specific examples, while indicating embodiments of the invention, are given by way of illustration only and not by way of limitation. Various substitutions, modifications, additions, and/or rearrangements within the spirit and/or scope of the underlying inventive concept will become apparent to those skilled in the art from this disclosure.

Figure 7A:
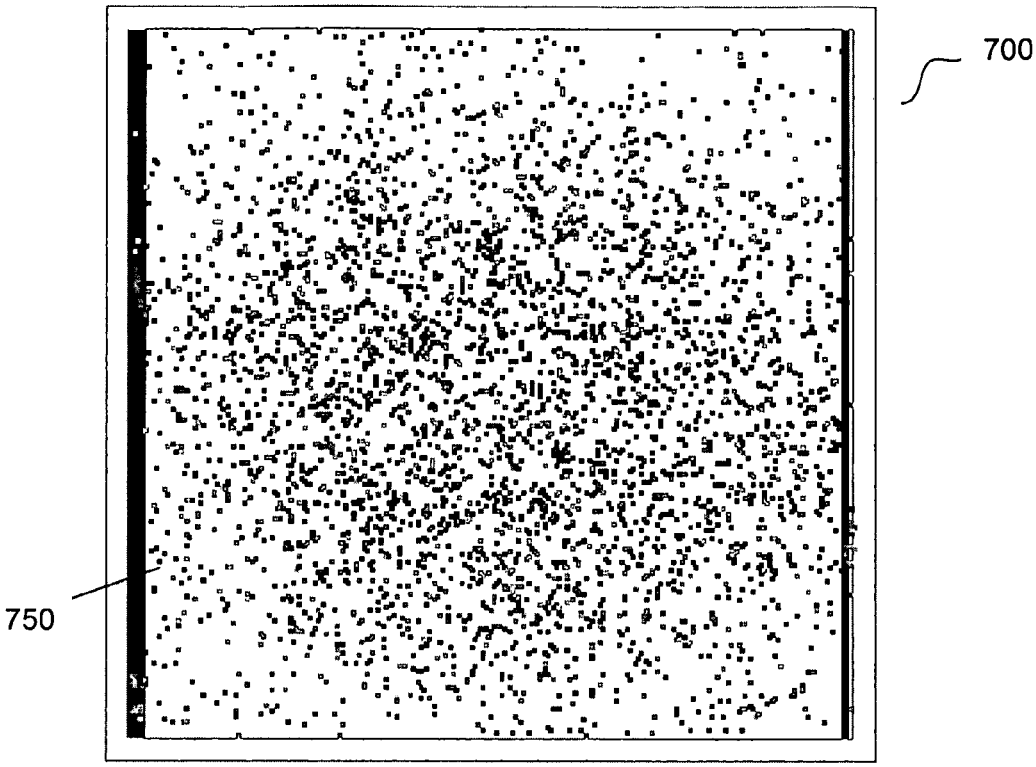
FIG. 7A is a quartz surface comprising cleaning particles, in accordance to an embodiment of the disclosure.

The present disclosure provides for generating a controlled size distribution of particles in a solution used to clean a surface, such as, but not limited to, a mask, wafer, glass plate, or other surfaces used in a fabrication process, and applying the particles to clean and/or remove contaminant particles of a surface. The energy transfer from the particles in a solution to a surface using techniques of the present disclosure is sufficient to remove the contaminant particles. In one embodiment, the particles of the solution may be selected such that they weakly adhere to the surface and thus, may be easily removed with other conventional cleaning techniques, as discussed in FIGS. 7A-7B below. In addition to or alternatively, by adjusting the pH of the solution, the particles in the solution may not adhere together, and therefore, provides for easy removal of the solution from the surface.

In one embodiment, the solution may include polystyrene latex (PSL) spheres, including, without limitation, silicon dioxide ($SiO_2$), aluminum oxide ($Al_2O_3$), cerium oxide ($CeO_2$), zirconium oxide ($ZrO_2$). In addition to or alternatively, the cleaning solution may also include boro silicate glass particles or soda lime glass particles or the like. In one embodiment, the PSL spheres, boro silicate glass particles or soda lime glass particles (collectively, cleaning particles) may range from about 10 nanometers to about 2000 micrometers in diameter. In addition to or alternatively, slurry materials, including silicon nitride, silica, or other particles that may have a sharp size distribution may be used to clean the surface.

Figure 1A:
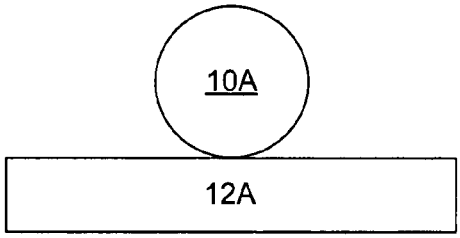
FIG. 1A shows a soft adhesion of a particle to a surface.
Figure 1B:
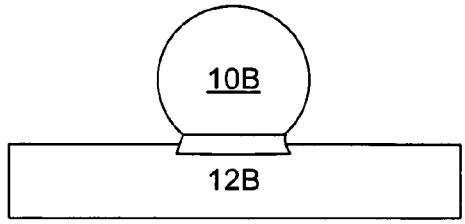
FIG. 1B shows a hard adhesion of a particle to a surface
Figure 2:
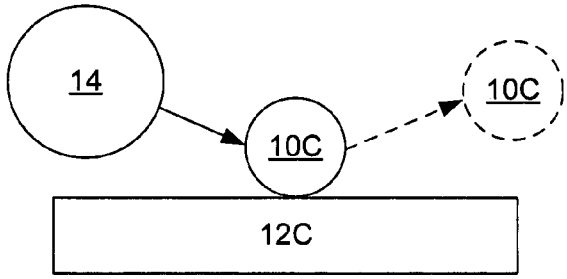
FIG. 2 (Prior Art)
FIG. 2 is prior art method for removing particles on a surface.
Figure 3:
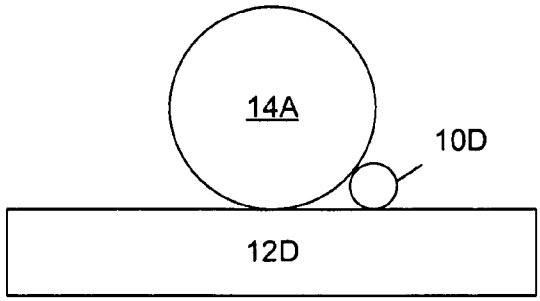
FIG. 3 (Prior Art)
FIG. 3 is a prior art method for removing particles on a surface.
Figure 6:
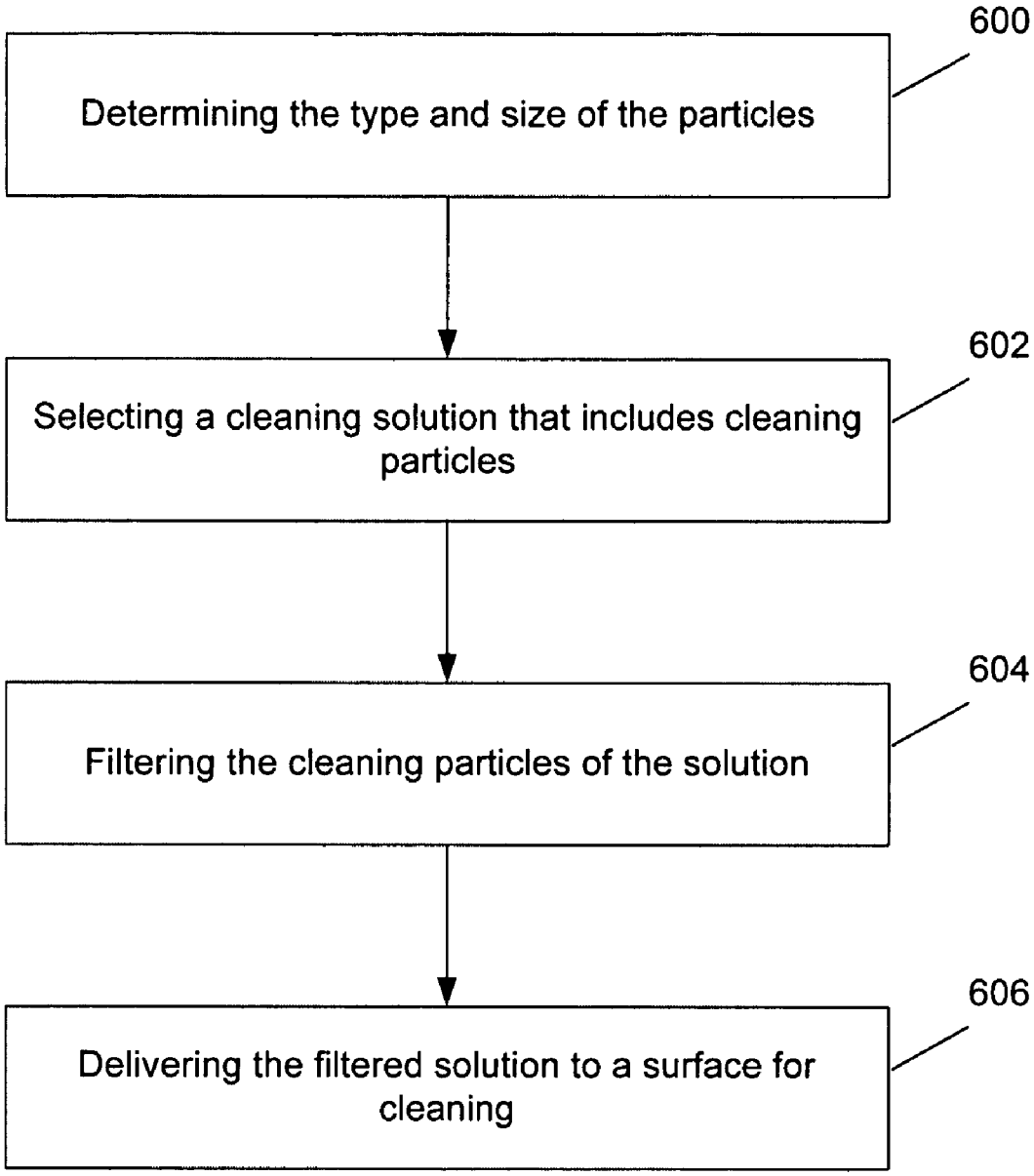
FIG. 6 is a flow chart of a method, in accordance to an embodiment of the disclosure.

Referring to FIG. 6, a method for removing contaminant particles is shown. In one embodiment, a surface may be evaluated to determine the type and size of the contaminant particles (step 600). The type of contaminant particles, either soft defects and/or hard defects (shown in FIGS. 1A and 1B, respectively) and the size of the contaminant particles may determine the type of cleaning solution, the velocity of which the solution is delivered, and other processing steps.

Next, a cleaning solution may be selected (step 602) and may be based on the ease of removing the solution from the surface after the cleaning process is complete. In one embodiment, the cleaning solution may include cleaning particles suspended in a suspending medium, such as an aqueous solution or gas. Alternatively or in addition to, the cleaning solution may include a surfactant (e.g., non-ionic surfactant and/or a silicone-based surfactant). Alternatively, the cleaning solution may be a slurry. The slurry may include, without limitation, cleaning particles (e.g., silica, silicon nitride, and the like) and basic solution that may prevent the cleaning solution from combining.

Step 602 may also include selecting the types of cleaning particles, and in particular, cleaning particles having similar or substantially the same size as the contaminant particles. In one embodiment, the cleaning particles may be selected from, for example, a reservoir comprising a plurality of cleaning particles with various sizes. For an effective cleaning method, the particles of the cleaning solution may be filtered, for example, via a filter such that a size of the cleaning particles is similar or substantially equal to the size of the contaminant particles is provided to the surface (step 604). Further, the filtering process aids in reducing the risk of damage the surface during the cleaning process by removing cleaning particles that may be ineffective (e.g., too large or too small).

Alternatively, step 602 may select the cleaning particles from a plurality of reservoirs. In particular, the plurality of reservoirs may each comprise a particular size of cleaning particles. As such, after determining the type and size of the contaminant particles (step 601), cleaning particles with similar or substantially the same size of the contaminant particles may be selected from one of the plurality of reservoirs and may subsequently be provided to the surface (step 606). In this embodiment, step 604 may be optional.

In step 606, the cleaning solutions, including the cleaning particles may be provided to the surface. In one embodiment, the solution may be provided via a nozzle, that may provide a collision impact between at least the cleaning particles and the contaminant particles and breaks the bond between the contaminant particles and surface and moves the contaminant particles away from the surface to prevent reattachment.

In some embodiments, a second cleaning solution may also be provided to the surface via a second nozzle, and may be simultaneous dispensed with the cleaning solution comprising the particles. The second cleaning solution may include, for example, an aqueous solution for aiding the cleaning process. The aqueous solution may include, without limitation, ammonium hydroxide ($NH_4OH$), peroxide ($H_2O_2$), ozonated water, any combination of the above, or other suitable solutions known in the art that may aid in the cleaning of a contaminated surface.

Figure 4:
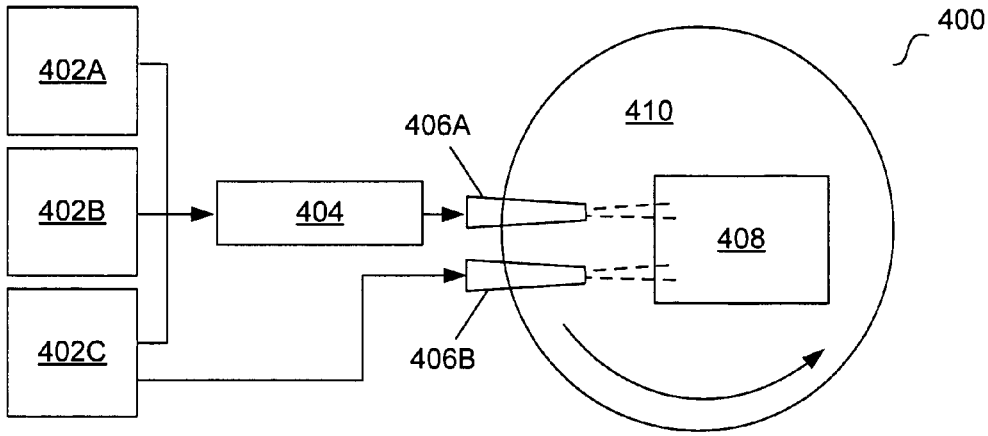
FIG. 4 is a top-view of a cleaning tool, in accordance with embodiments of the disclosure.
Figure 5:
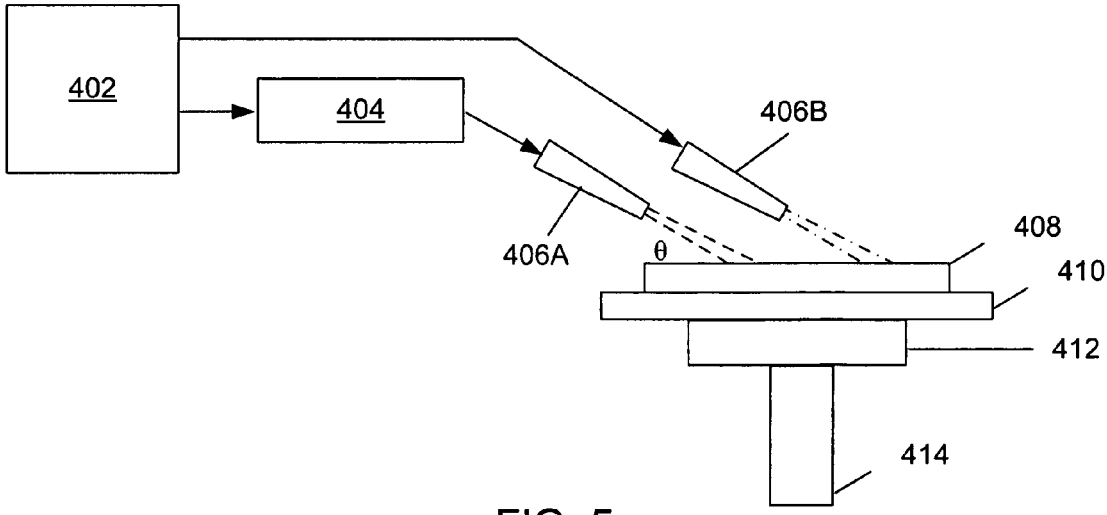
FIG. 5 is a side-view of a cleaning tool, in accordance with embodiments of the disclosure.

Referring to FIGS. 4 and 5, a top view and a side view of cleaning tool 400 according to an embodiment of the disclosure is shown, respectively. Tool 400 may include reservoir 402A, 402B, and 402C (collectively reservoirs 402) for storing a cleaning solution. In one embodiment, reservoirs 402 may each include cleaning particles of various sizes. Alternatively, reservoir 402A, 402B, 402C may each include a different cleaning solution. For example, reservoir 402A may include a cleaning solution containing cleaning particles of size A and reservoir 402B may include a cleaning solution containing cleaning particles of size B, where size A and size B are different.

Coupled to reservoirs 402 may be an agitator (not shown). The agitator may be an ultrasonic agitator operating at about 20 kilohertz (kHz) to about 500 kHz. The agitator may commove or mix the particles such that the particles do not combine. The above operating frequency is non-limiting, and one with ordinary skill in the art can understand that other operating frequencies may be used depending on, for example, the types of particles and the size of particles.

In some embodiments, filter 404 may be coupled to reservoirs 402. Filter 404 may be used to select a desired size distribution of cleaning particles in a cleaning solution having various cleaning particles sizes. For example, particles having a similar size to the contaminant particles may be selected. This selection reduces, and may even eliminate, surface damage caused by either having large cleaning particles that are not effective in removing surface contaminants or by having too small of a cleaning particle such that the transfer of energy is insufficient for removal. For multiple reservoirs, each containing a particular cleaning particle size, filter 404 may be an optional component Referring again to FIGS. 4 and 5, nozzle 406A coupled to reservoirs 402 and/or filter 404 may be provided. Nozzle 406A may be a spray nozzle for providing the cleaning solution and the desired cleaning particles onto contaminated surface 408. Alternatively, nozzle 406A may be an interchangeable nozzle configured to provide different spray angles and different spray distribution.

In one embodiment, the velocity of the cleaning solution and the angle between nozzle 406A and surface 408 may be carefully controlled, e.g., manually, mechanically, electronically, etc., in order to minimize the damage to the surface. In one embodiment, the cleaning solution may be applied to surface 408 at an angle θ and at a velocity, v. Simultaneously, surface 408 coupled to plate 410, may be rotated at an angular velocity ω by motor 414, which may be coupled to chuck 412.

In other embodiments, to minimize the damage to the surface and introduction of new contaminant particles to surface 408, nozzle 406A may move in a horizontal and/or vertical direction relative to surface 408 at some velocity. Alternatively, surface 408 may move relative to nozzle 406A in a vertical and/or horizontal direction via motor 414 to reduce or even eliminate contaminant particles from generating during the cleaning process.

In some embodiments, the flow velocity of the solution and the angle of nozzle 406A relative to the surface may be considered in order to minimize damage to the surface. As such, the total collision impact from the cleaning solution, and in particular, the cleaning particles to the surface, which may be proportional to the volume flow (liters/minute) and the square root of the pressure from the nozzle, may be adjusted.

Figure 7B:
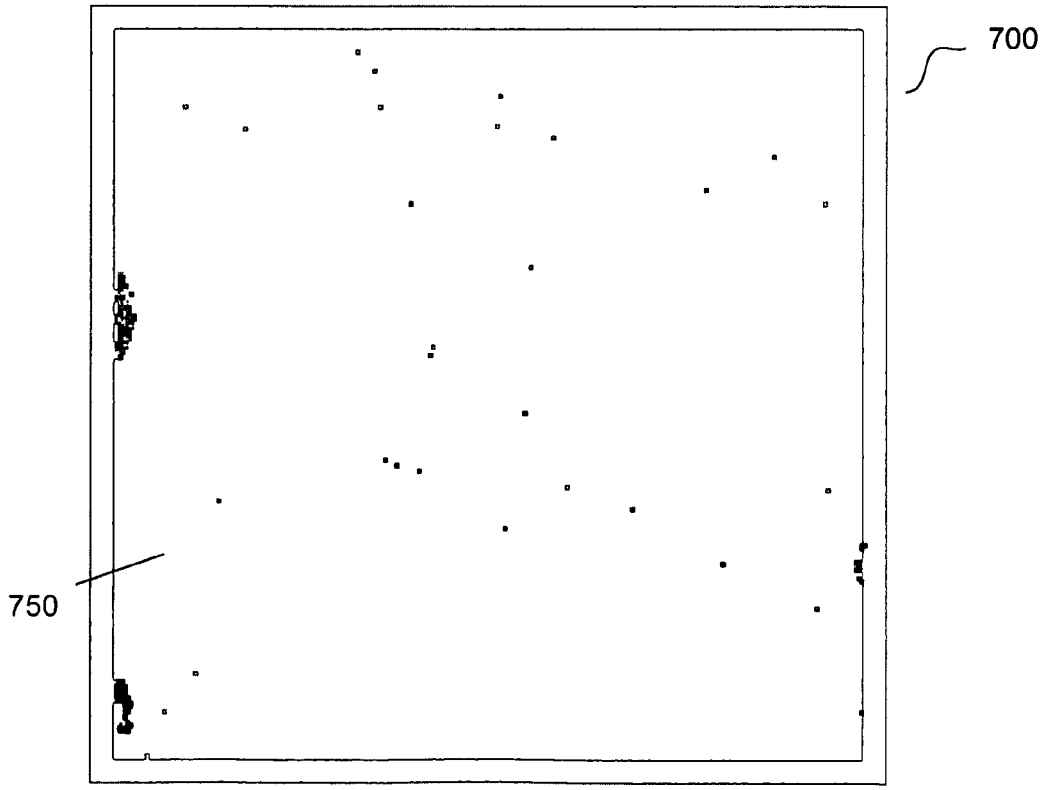
FIG. 7B is the quartz surface of FIG. 7A after removing the cleaning particles, in accordance to an embodiment of the disclosure.

In some embodiments, a second nozzle, e.g., nozzle 406B may be provided. Nozzle 406B may be a separate nozzle coupled to nozzle 406A. Alternatively, nozzles 406A and 406B may be an integral unit. Nozzle 406B may be a megasonic nozzle operating between about 800 kilohertz (kHz) and about 7 megahertz (MHz). Nozzle 406B may be coupled to surface 408 and may be used to provide cleaning solutions to aid in the cleaning of the contaminated surface. In one respect, nozzle 406B may be coupled to at least one of reservoir (e.g., reservoir 402C) containing a cleaning solution, such as, but not limited to ammonium hydroxide ($NH_4OH$), peroxide ($H_2O_2$), and/or ozonated water. The dispensing of the cleaning solution may be simultaneous with the dispensing of the cleaning solution and cleaning particles. Alternatively, nozzle 406B may dispense the cleaning solution after the cleaning process to remove the cleaning particles. For example, referring to FIG. 7A, a 152 nm×152 nm glass surface 700 comprising PSL particles ranging in size from about 43 nanometers to about a few microns are shown. The tested area (area 750) is approximately 142 nm×142 nm. A combination of ammonium hydroxide and ozonated water was dispense, using a megasonic nozzle similar to nozzle 406B to remove the cleaning particles. As shown in FIG. 7B, about a 97 percent of the cleaning particles were removed. Subsequent dispensing of ammonium hydroxide ($NH_4OH$), peroxide ($H_2O_2$), and/or ozonated water may remove the remaining cleaning particles.

Cleaning tool 400 may also include an inline pH sensor (not shown) coupled to reservoirs 402. In some embodiments, the pH sensor may be used to determine the pH level of the cleaning solution. Upon reaching a predetermined threshold (depending on the types of cleaning solution), the pH level of the contaminant solution may be altered to prevent the cleaning particles from attaching to one another.

All of the methods disclosed and claimed herein can be made and executed without undue experimentation in light of the present disclosure. While the apparatus and methods of this invention have been described in terms of preferred embodiments, it will be apparent to those of skill in the art that variations may be applied to the methods and in the steps or in the sequence of steps of the method described herein without departing from the concept, spirit and scope of the invention. In addition, modifications may be made to the disclosed apparatus and components may be eliminated or substituted for the components described herein where the same or similar results would be achieved. All such similar substitutes and modifications apparent to those skilled in the art are deemed to be within the spirit, scope, and concept of the invention as defined by the appended claims.

The invention claimed is:

1. A method comprising:

providing a surface contaminated with contaminant particles;

determining a size of the contaminant particles;

producing a cleaning solution including a plurality of cleaning particles selected to have a size substantially equal to a size of the contaminant particles; and delivering the cleaning solution and the cleaning particles to the surface for removing the contaminant particles.

2. The method of claim 1, further comprising adjusting a pH of the cleaning solution to separate the plurality of cleaning particles within the solution.

3. The method of claim 1, the producing step comprising, filtering a pre-filtered solution having a plurality of cleaning particles of various sizes to produce the cleaning solution including the plurality of cleaning particles selected to have a size substantially equal to the size of the contaminant particles.

4. The method of claim 1, the producing step comprising, selecting from a plurality of candidate cleaning solutions the cleaning solution including the plurality of cleaning particles having a size substantially equal to the size of the contaminant particles.

5. The method of claim 1, further comprising agitating the cleaning solution to maintain the suspended cleaning particles separate.

6. The method of claim 1, further comprising, cleaning the surface with ammonium hydroxide ($NH_4OH$), peroxide ($H_2O_2$), or ozonated water.

7. A method comprising:

providing a surface contaminated with contaminant particles;

determining a size of the contaminant particle;

providing a cleaning solution having a plurality of variable size cleaning particles;

filtering the cleaning solution having the plurality of variable size cleaning particles to produce a filtered cleaning solution including a plurality of cleaning particles having a size substantially equal to a size of the contaminant particles; and delivering the filtered solution to the surface at a predetermined velocity for removing the contaminant particles.

8. The method of claim 7, further comprising, adjusting a pH of the cleaning solution to separate the plurality of variable size cleaning particles in the solution.

9. The method of claim 7, the delivering step comprising, adjusting an angle of the delivery of the solution to the surface to reduce damage to the surface.

10. The method of claim 7, the delivering step comprising, moving the surface to reduce damage to the surface.

11. The method of claim 10, the moving step comprising, rotating the surface.

* * * * *